US006872295B2

(12) United States Patent
Palmans et al.

(10) Patent No.: US 6,872,295 B2
(45) Date of Patent: Mar. 29, 2005

(54) METHOD FOR PREPARING AN ELECTROPLATING BATH AND RELATED COPPER PLATING PROCESS

(75) Inventors: Roger Palmans, Riemst (BE); Yuri Lantasov, Minsk (BY)

(73) Assignee: Interuniversitair Microelektronica Centrum (IMEC), Leuven (BE)

( * ) Notice: Subject to any disclaimer, the term of this patent is extended or adjusted under 35 U.S.C. 154(b) by 396 days.

(21) Appl. No.: 10/017,453

(22) Filed: Dec. 12, 2001

(65) Prior Publication Data

US 2002/0153259 A1 Oct. 24, 2002

Related U.S. Application Data

(60) Provisional application No. 60/257,649, filed on Dec. 22, 2000.

(30) Foreign Application Priority Data

Dec. 13, 2000 (EP) ..... 00870299

(51) Int. Cl.[7] ..... C25D 3/38; C25D 5/10

(52) U.S. Cl. ..... 205/295; 205/182; 205/183; 205/186

(58) Field of Search ..... 205/295, 182, 205/183, 186, 296, 170

(56) References Cited

U.S. PATENT DOCUMENTS 4,673,469 A * 6/1987 Beach et al. ..... 205/169
5,454,930 A 10/1995 Miura et al.
6,398,855 B1 6/2002 Palmans et al.
6,585,811 B2 7/2003 Palmans et al.

FOREIGN PATENT DOCUMENTS

WO WO 99/47731 9/1999

OTHER PUBLICATIONS

Hackh's Chemical Dictionary, 4th edition, 1969, p. 314.*
European Search Report; appln No. EP 00 87 0299; dated May 21, 2001.

* cited by examiner

*Primary Examiner*—Kishor Mayekar
(74) *Attorney, Agent, or Firm*—Knobbe Martens Olson & Bear LLP

(57) ABSTRACT

The present invention is related to a method for the preparation of a composition for electroplating a copper-containing layer on a substrate. This method makes use of an aqueous solution that has at least: a source of copper Cu(II) ions, an additive to adjust the pH to a predetermined value, and a complexing agent for complexing Cu(II) ions. The complexing agent has the chemical formula:

$$COOR_1—COHR_2R_3$$

in which $R_1$ is an organic group covalently bound to the carboxylate group (COO), $R_2$ is either hydrogen or an organic group, and $R_3$ is either hydrogen or an organic group. The solution has no reducing agent. The method involves providing electrons from a source not in direct contact with the solution, through transport means that provides the contact between said source and said solution. The present invention is also related to a process for forming a copper-containing layer on a substrate in an electroplating bath prepared according to the foregoing method.

25 Claims, 2 Drawing Sheets

Figure 2
Fig 2a)
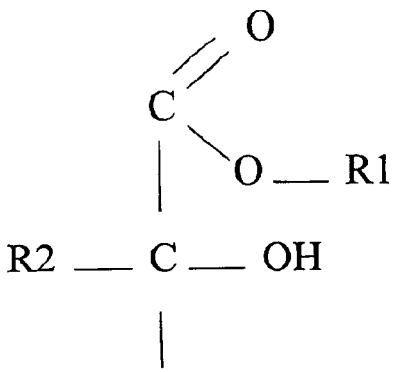
Fig 2b)
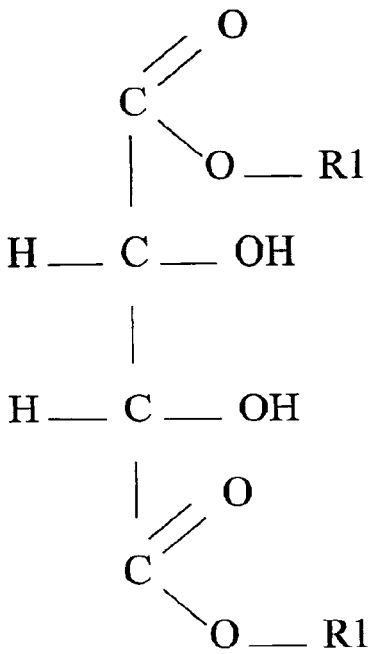
Fig 2c)
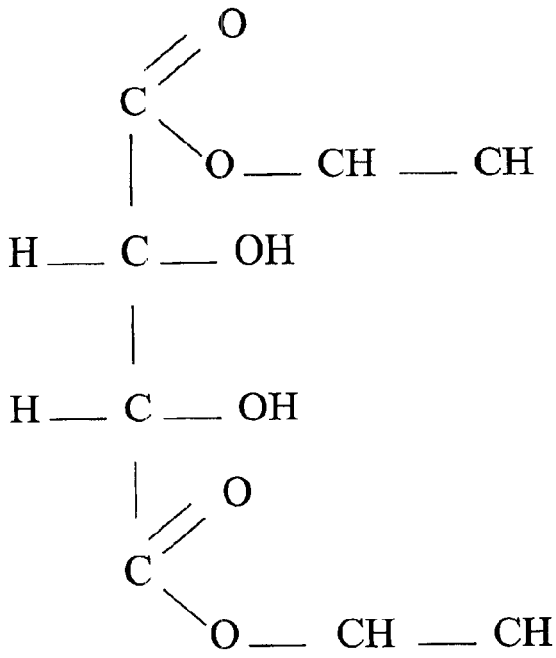

METHOD FOR PREPARING AN ELECTROPLATING BATH AND RELATED COPPER PLATING PROCESS

This application claims the benefit of U.S. Provisional Application No. 60/257,649, filed Dec. 22, 2000.

FIELD OF THE INVENTION

The present invention is related to a new method for preparing a copper electroplating bath.

The present invention is also related to a process for copper deposition on a substrate using the electroplating bath prepared by said method.

The field of the present invention is the deposition of a copper-containing layer or of a copper-containing pattern used for electrical connections of active or passive microelectronic devices as well as integrated circuits.

BACKGROUND OF THE INVENTION

Currently, copper is being introduced in ULSI metallization schemes as a replacement for aluminum due to its lower resistivity and better electromigration resistance. Electroplated copper is becoming the method of choice for depositing copper layers for metallization schemes based on dual damascene back-end technology in ULSI processing.

One requirement of electroplating copper is to have a copper seed layer on top of the copper diffusion barrier layer in order to obtain uniform plating. Different techniques have been proposed in order to obtain an adequate copper seed layer.

Among these techniques is direct galvanic plating of copper from classical commercial copper electroplating baths. However, this technique has proved to be elusive, yielding non-uniform copper deposition on the barrier layer, with very bad adhesion and poor quality of the plated copper films (copper dust).

As an alternative, copper seed layers have traditionally been deposited by PVD techniques, such as IMP-Cu sputtering or long-throw sputtering. However, these techniques require to sputter copper seed thicknesses of around 150 nm or more in order to get sufficient copper coverage on the sidewalls of the features, due to the high aspect ratio of the features to be filled with copper (trenches and/or vias). Indeed, the sidewalls of the features have to be completely covered with copper, as the subsequent electroplating step critically depends on an uninterrupted path for current lines throughout the features. In the presence of sidewall defects due to interrupted copper seed layer deposition, large voids are observed after full copper layer plating. Also, the typical overhang of the 150–200 nm thick PVD copper layer at the entrance of narrow trench and/or via features can result in less than adequate filling with electroplated copper.

Therefore, there is a need for the future technologies to deposit thinner and more conformal copper seed layers on barrier layers in order to be able to fill the very narrow features with standard ECD copper.

In WO99/47731 a solution to this problem has been proposed, which is based on a PVD seed layer repair or mending technique using an electroplating process step after PVD seed layer deposition and prior to full copper plating. However, the plating mostly occurs on the already deposited PVD copper seed layer whereas the adhesion to the originally uncovered barrier layer (e.g. TaN) is expected to be very poor. This can possibly result in reliability problems after full metallization processing.

A possible option for more conformal seed layer deposition on barrier layers is Cu-CVD which results in substantially improved step coverage as compared to the PVD techniques. However, this technique has never gained wide acceptance in the field, most likely due to the high cost of the technology and the fairly rough copper films deposited with this technique.

Electroless copper is another possibility for deposition of copper layers. The principle of electroless metal deposition is based on the generation of electrons at a catalytically active or an activated surface in contact with a solution of metal ions in the presence of a suitable sacrificial electron donor. These electrons are capable of reducing the metal ions leading to the deposition of the metal on the activated surface. However, electroless plating baths have often a limited stability and can only be effectively used in a limited pH range which makes them very sensitive for slight variations in the composition of the plating solution. Such variations result in small variations in the pH but often lead to a large decrease in the deposition rate. Moreover, most electroless copper plating solution compositions are based on salts containing mainly sodium as the counterion. These high levels of sodium ions in the plating solutions can introduce severe reliability problems, particularly when sodium reaches the semiconductor device junctions, as this is known to be a production yield killer in semiconductor device manufacturing.

In conclusion the need for satisfying techniques to deposit thinner and more conformal copper seed layers on barrier layers still exists.

SUMMARY OF THE INVENTION

The present invention aims to provide a new method for preparing an electroplating bath for deposition of conductive metal-containing layers, especially those containing copper.

In one embodiment, the present invention aims to provide a new method for preparing an electroplating bath, said bath being able to be used for deposition of thin copper seed layers directly on an underlying barrier layer, said barrier being possibly conductive.

Various embodiments of the present invention also aim to provide a method for preparing an electroplating bath that yields excellent quality copper seed layers on barrier layers.

Some embodiments of the present invention also aim to provide a method for preparing a new electroplating bath which is environmentally acceptable.

It is a further aim of particular embodiments of the present invention to provide a process for electrolytic deposition of a copper-containing layer using the electroplating bath prepared according to said new method.

Thus, one aspect of the present invention is related to a method for the preparation of a composition for electroplating a copper-containing layer on a substrate, comprising the steps of:

(i) providing an aqueous solution comprising at least:

a source of copper Cu(II) ions, an additive to adjust the pH to a predetermined value, and a complexing agent for complexing Cu(II) ions, said complexing agent having the chemical formula:

$$COOR_1—COHR_2R_3$$

wherein $R_1$ is an organic group covalently bound to the carboxylate group (COO), $R_2$ is either hydrogen or an organic group, and $R_3$ is either hydrogen or an organic group, said solution comprising no reducing agent, (ii) providing electrons from a source not being in direct contact with said solution, through transport means assuming the contact between said source and said solution.

The source supplying electrons can be placed in said solution or outside said solution.

Preferably, the source supplying electrons is a current generator or a battery and the transport means comprise electrodes bound to wires.

Preferably, the source supplying electrons has a current density comprised between 0.32 mA/cm$^2$ to 3.82 mA/cm$^2$.

In a first preferred embodiment, $R_2$ in the complexing agent is hydrogen, $R_3$ is an organic group and $R_1$ is an organic group covalently bound to the carboxylate group (COO).

In a second preferred embodiment, $R_2$ in the complexing agent is hydrogen, $R_3$ is —CHOH—COOR1 and $R_1$ is an organic group covalently bound to the carboxylate group (COO).

In a third preferred embodiment, $R_2$ is hydrogen, $R_3$ is an organic group, as in the first embodiment, and $R_1$ is a hydrocarbon group.

In a fourth preferred embodiment, $R_2$ is hydrogen and $R_3$ is —CHOH—COOR1, as in the second preferred embodiment, and and $R_1$ is a hydrocarbon group.

In another preferred embodiment, the complexing agent is selected from the group consisting of L-diethyltartrate, L-diisopropyltartrate, L-dimethyltartrate, L-dibutyltartrate, L-ethyllactate, D-diethyltartrate, D-diisopropyltartrate, D-dimethyltartrate, D-dibutyltartrate and D-ethyllactate or a mixture thereof.

Preferably, the source of copper Cu(II) ions in the solution is $CuSO_4.5H_2O$.

Preferably, the additive to adjust the pH of the composition is $[Me_4N]OH$ (TMAH).

Preferably, the pH of said composition is comprised between 11 and 13.5, more preferably between 12 and 13.5, more preferably between 12.3 and 13.3.

The present invention is also related to a process for forming at least one copper-containing layer on a substrate comprising at least the step of electroplating a copper-containing layer onto said substrate in a first electroplating bath, characterised in that said electroplating bath is the composition prepared by the method according to the invention and mentioned hereabove.

Preferably, the temperature of the composition is between 10° C. and 50° C., preferably between room temperature (i.e. 15° C. to 25° C.) and 45° C.

The copper-containing layer can be formed directly on the substrate.

The copper-containing layer can also be formed indirectly on the substrate after a pre-step of forming a primary layer on said substrate, so that said copper-containing layer is formed on said primary layer.

Preferably, said primary layer is a copper diffusion barrier layer.

Said copper diffusion barrier layer can be metal conductive or not.

Preferably, said copper diffusion barrier layer is selected from the group consisting of a Ti layer, a TiN layer, a Ta layer, a $WN_x$ layer, a TaN layer, a Co layer and a Co-alloy layer.

The resulting copper-containing layer is a copper seed layer.

In this embodiment, the process according to the invention further comprises the step of forming another copper-containing layer on the last formed copper seed layer using a second electroplating bath.

The second electroplating bath can be the first electroplating bath used for forming the copper seed layer.

The second electroplating bath can also a cupric-sulfuric acid based electroplating bath, as already used in the standard electroplating techniques.

BRIEF DESCRIPTION OF THE DRAWINGS

FIG. 2*a* represents the general chemical structure of the complexing agent.

FIG. 2*b* gives the chemical structure of an organic tartrate used as complexing agent in a preferred embodiment of the method according to the present invention.

FIG. 2*c* gives the chemical structure of the diethyltartrate used as particularly preferred complexing agent in the method of the present invention.

DETAILED DESCRIPTION OF THE INVENTION

Figure 1:
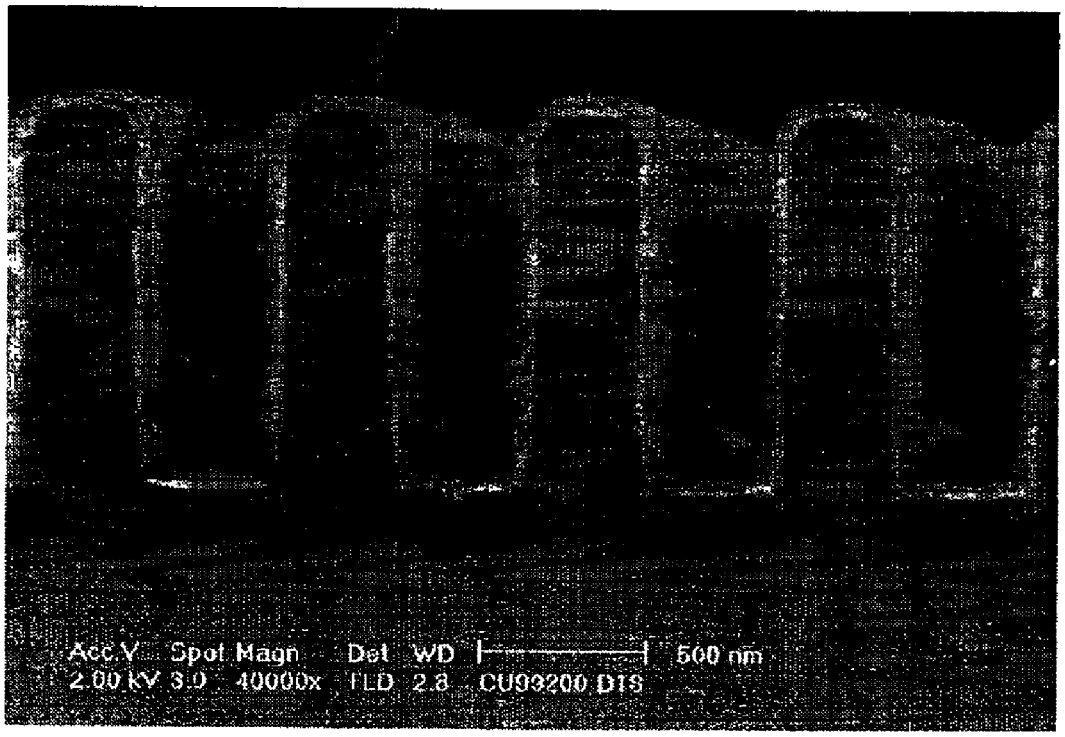
FIG. 1 represents an SEM picture of an electroplated copper layer obtained with the process and bath according to the present invention.

In relation to the appended drawings the present invention is described in details in the sequel. It is apparent however that a person skilled in the art can imagine several other equivalent embodiments or other ways of executing the present invention.

In a first aspect of this invention, the method for the preparation of a composition for electroplating a copper-containing layer on a substrate, comprises the steps of:

(i) providing an aqueous solution comprising at least:

a source of copper Cu(II) ions, an additive to adjust the pH to a predetermined value, and a complexing agent for complexing Cu(II) ions, said complexing agent having the chemical formula:

$$COOR_1—COHR_2R_3$$

wherein $R_1$ is an organic group covalently bound to the carboxylate group (COO), $R_2$ is either hydrogen or an organic group, and $R_3$ is either hydrogen or an organic group, said solution comprising no reducing agent, (ii) providing electrons from a source not being in direct contact with said solution, through transport means assuming the contact between said source and said solution. FIG. 2*a* gives the structure of said chemical compound in more details.

The source supplying electrons can be a current generating device.

Said source can be placed outside said solution or can be placed in the solution, as long as there is no direct contact between the source and the solution.

The groups $R_1$, $R_2$ and $R_3$ can be every organic group that assures a good complexation between the copper ions and the chemical compound. Said chemical compound can be the D- or the L-form of the compound or a racemic mixture.

In an embodiment of this first aspect of the invention, $R_2$ is hydrogen and $R_3$ is an organic group.

In another embodiment of this first aspect of the invention, $R_2$ is hydrogen and $R_3$ is —CHOH—$COOR_1$, as illustrated in FIG. 2*b*.

In another embodiment of this second aspect of the invention, said $R_1$ is a hydrocarbon group.

For instance, said chemical compound is selected from the group consisting of diethyltartrate, diisopropyltartrate, dimethyltartrate, dibutyltartrate and ethyllactate. Those molecules can be the D-form or the L-form. FIG. 2*c* gives the chemical structure of diethyltartrate, for which $R_1$ is $CH_2CH_3$.

The pH of the composition as recited in this first aspect can be in the range between 11 and 13.5. For instance, the pH is in the range between 12.3 and 13.3.

The temperature at which the solution can be applied ranges from 10 to 50° C. or, 45° C. or below, or from room temperature (i.e. 15° C. to 25° C.) to 45° C.

In a second aspect of the invention, the process according to the present invention for forming a copper-containing layer on a substrate, comprises the step of electroplating a copper-containing layer onto a substrate using an electroplating bath, characterized in that said electroplating bath is the composition prepared by the method according to the invention mentioned hereabove.

Contrary to electroless plating baths, said electroplating bath does not contain a sacrificial electron donor compound that is able to reduce $Cu^{2+}$ to Cu such as, but not limited hereto, formaldehyde. This is a major advantage since formaldehyde vapors are a potential health liability because of suspected carcinogenity. Moreover, this electroplating bath does not contain alkali metal ions, such as sodium or potassium. The presence of those ions can be detrimental for the reliability of e.g. semiconductor devices since these ions have a high mobility and can easily migrate to the junction level.

The process according to the present invention can be performed for different uses.

Said process can be used for forming a copper-containing layer on a conductive layer.

Moreover, said process can be also used for the formation of a copper-containing layer on a copper diffusion barrier layer. Preferably, said copper diffusion barrier layer is a conductive copper diffusion barrier layer.

Said process can also be used for the formation of a copper-containing seed layer. Then the obtained copper-containing seed layer can be used as seed layer for the deposition of electroplated copper on both blanket wafers, i.e. without openings, and wafers with openings with widths down to 0.1 micron and with an aspect ratio (depth/with ratio op the opening) of 4 or even higher. Said opening can be a trench, via or contact hole. Particularly, said wafer can be a wafer with a single or dual damascene trench structures. Said copper-containing layer can be formed on a flat substrate or can be formed in e.g. an opening in said substrate.

The process according to the present invention results in the deposition of conformal copper layers, as illustrated in FIG. 1.

Usually, deposition of copper-containing layer involves two plating steps. In a first step, a copper-containing seed layer is formed, typically, but not limited hereto, on a barrier layer. Up to now, the seed layer is formed by electroless plating, PVD or by CVD. In a second step, the copper-containing layer is further deposited by electrochemical deposition using classic plating baths.

The substrate can be at least a part of a partly processed or a pristine wafer or slice of a semi-conductive material, like e.g. Si or GaAs or Ge or SiGe, or an insulating material, like e.g. a glass slice, or a conductive material. Said substrate can comprise a patterned insulating layer.

Particularly, if said substrate is a partly processed wafer or slice, at least a part of the active and/or passive devices can already be formed and/or at least a part of the structures interconnecting these devices can be formed.

Examples of Cu diffusion barrier layers are Ti, TiN, Ta, $WN_x$, TaN, Co or any combination thereof. A more particular example of such a barrier layer is TiN.

The hydrogen evolution is substantially limited during deposition on a barrier layer, this means that on such barrier layers high quality Cu-containing layers with a thickness of at least 150 nm or at least 300 nm can be formed. Also thicker layers can be formed e.g. layers with a thickness ranging up to 1 $\mu$m or even up to 2 $\mu$m.

Successful electroplating of copper on barrier layers involves cleaning of the barrier layer surface prior to copper plating.

For instance, cleaning of a TiN surface can be accomplished with diluted HF solutions in order to remove surface $TiO_xCN_y$ species. Other cleaning procedures have been described in the literature.

Each process step should be preferably followed by an adequate rinse, for instance with DI water, as usually required in the art.

In some instances, depending on the quality of the TiN surface, additional drying after either pre-clean or activation step, or after both steps, can improve the electroplated copper-containing layer quality.

The resulting copper seed layers fulfil the requirements for subsequent electrolytic copper filling by means of standard commercial cupric-sulfuric acid based plating baths currently in use in the field.

The specific composition of the seed layer plating bath and the current settings are important for this technology to work.

The process of the present invention presents several advantages, among which is simplification of the processing. Indeed, both the step of forming the copper-containing seed-layer and the step of forming the second copper-containing layer are implementable on existing copper plating tools.

Other advantages of this process are (i) excellent adhesion to the barrier layers , e.g. but not limited hereto, TiN or TaN, low cost; (ii) simplified processing, implementable on existing copper plating tools; (iii) easy maintenance of the plating bath; (iv) cheap processing; and (v) environmentally acceptable components in the plating bath (no noxious components).

In a preferred embodiment of the invention, the process according to the present invention uses an electroplating bath which is an aqueous solution comprising a source of copper Cu(II) ions, an additive to adjust the pH of said aqueous solution to a predetermined value and a chemical compound for complexing Cu(II) ions, said chemical compound having at least one part with the following chemical structure:

$$COOR_1—CHOH—CHOH—COOR_1$$

as illustrated in FIG. 2*b*, $R_1$ being an organic group covalently bound to the carboxylate group (COO).

At least for the purpose of this disclosure, an organic tartrate is defined as a chemical compound with chemical structure:

$$COOR_1—CHOH—CHOH—COOR_1$$

$R_1$ being an organic group covalently bound to the carboxylate group (COO).

For instance, these organic groups can be hydrocarbon groups.

Examples of such organic tartrates are diethyltartrate, diisopropyltartrate, dimethyltartrate or dibutyltartrate. FIG.

2*c* gives the chemical structure of diethyltartrate, for which $R_1$ is $CH_2CH_3$.

In order to avoid copper(II) hydroxide deposition at high pH values, an organic tartrate is added for complexing the Cu(II) ions. Particularly, diethyltartrate, is used. The organic tartrates are characterized by a different complexation behaviour with Cu(II) ions as compared to ionic tartrate, i.e. tartrate$^{2-}$ ions based salts. Probably this complexation is mainly, but not limited hereto, based on at least one hydroxyl group of the organic tartrate, particularly on the corresponding anion.

$CuSO_4.5H_2O$ can be used as a source of copper Cu(II) ions but other copper sources known in the art are also convenient.

The operation range for the pH of this plating solution is typically between pH 11.0 and 13.5. The correct pH value is adjusted by addition of an additive like e.g. tetra-N-methylammoniumhydroxide ($Me_4NOH$). Other examples are alkaline compounds such as the hydroxides or others known in the art. Preferably, the pH range is between 12.3 and 13.5, and most preferably between 12.3 and 13.3. Higher pH levels are possible but require much more addition of base without substantially improving the copper film quality or filling capabilities.

The temperature at which the solution can be applied ranges from 10 to 50° C., 45° C. or below, or from room temperature to 45° C. The temperature depends on the specific composition and can be influenced by, for instance, the concentration of the complexing agent (e.g. organic tartrate).

The applied current ranges, but is not limited hereto, from 0.01 A to 4 A for an 8 inch wafer, preferably between 0.1 A and 1.2 A, corresponding current density 0.32 mA/cm$^2$ for 0.1 A to 3.82 mA/cm$^2$ for 1.2 A.

The deposition time depends on the required thickness of the copper-containing layer. Typically, deposition times can be, but are not limited hereto, between 1 min. and 75 min.

Cleaning in diluted HF solutions is adequate for TiN barrier layers. The concentration range from 0.5% (2 min) to 10% (10 sec) proved to be useful. It was shown that HF is able to remove the slightly oxidized TiN surface layer without attacking the TiN layer itself.

The plating bath for thin copper seed layer plating on barrier layers consists of 3 components: cupric sulfate $CUSO_4.5H_2O$ as the source of Cu(II) ions, diethyltartrate (DET) as the complexing ligand to keep Cu(II) in solution at high pH, and $[Me_4N]OH$ (TMAH) to adjust the pH to the required level for good quality plating.

Plating on full 8 inch wafers was performed in a standard electroplating chamber on a commercial plating tool (Semitool ECD chamber) without any modification of the plating chamber setup. The standard Cu(P) anode was used as counterelectrode for the wafer. Electrical contact to the barrier layer was made with a series of contacts around the perimeter of the wafer with a protective ring to avoid any wetting of the contacts by the plating solution during plating (edge exclusion of 4.7 mm).

The standard diffusor plate for Cu ECD plating was used for our plating tests.

It should be understood that the application of this patent is not limited to this specific plating tool. This invention should be feasible in any other existing or future plating tool that has similar capabilities for full wafer copper plating.

Table 1 lists the results for the plating bath of the preferred embodiment. The deposition time is 10 minutes.

TABLE 1

| CuSO4/ DET (g/l ml/l) | Temperature (° C.) | pH | Current (A) | Rs (Ω/sq) (± std. Dev. %) | Thickness (nm) | dep. rate (nm/min) | resistivity (μΩ-cm) |
|---|---|---|---|---|---|---|---|
| 2.4/4.15 | 25 | 12.5 | 0.15 | 0.585 (±1.51%) | 56.4 | 5.64 | 3.50 |

Dep. time = deposition time

Rs = sheet resistance

Dep. Rate = deposition rate

Std. Dev. = standard deviation

Certain Preferred Embodiments of the Invention

In a preferred embodiment of this invention, a copper-containing layer is deposited on a TiN/Ti or TaN diffusion barrier layer. The barrier layers are deposited on dielectric layers such as plasma-CVD deposited silicondioxide (or any other dielectric layer known in the art such as polymer-based dielectric layers, xerogels, . . . ).

These barrier layers were sputter deposited by ionized metal plasma (IMP) except for a few test depositions performed on a CVD-TiN barrier layer. The filling capabilities of the new process was tested on patterned oxide wafers with single damascene trench test structures dry etched in $SiO_2$ and covered with IMP-TiN/Ti or TaN.

TMAH is added up to the required pH value. The pH in this embodiment is 12.5, but higher pH levels are also possible but require much more addition of base without substantially improving the copper film quality or filling capabilities.

Description of Further Embodiments

Experiments were repeated for different conditions as given in Table 2. The deposition time is 10 minutes for all experiments.

TABLE 2

| CuSO4/DET (g/l ml/l) | Temp (° C.) | pH | Current (A) | Rs (Ω/sq) (± stand. Dev. %) | Thickness (nm) | dep. rate (nm/min) | resistivity (μΩ-cm) |
|---|---|---|---|---|---|---|---|
| 2.4/8.3 | 25 | 12.5 | 0.15 | 0.808 (±9.02%) | 49.1 | 4.91 | 4.31 |
| 2.4/8.3 | 35 | 12.5 | 0.15 | 0.530 (±4.37%) | 106.6 | 10.66 | 5.96 |
| 2.4/8.3 | 25 | 13.3 | 0.15 | 0.434 (±0.631%) | 79.7 | 7.97 | 3.61 |
| 2.4/8.3 + Triton-X | 25 | 12.5 | 0.15 | 0.631 (±2.65%) | 51.4 | 5.14 | 3.46 |

For the DET concentrations of 8.30 ml/L, a relatively small effect is seen on the copper deposition rate with a decrease of the deposition rate from about 5.6 to 4.9 nm/minute compared to the referred embodiment. However, the specific resistivity of the deposited copper layers increases substantially at the higher ligand concentration. The adhesion proved to be slightly better for the lower DET concentration bath for similar thicknesses of the copper layers.

For the plating bath: (Cu(II) 2.4 g/L, DET 8.30 ml/L), plating is possible at temperatures up to at least 35° C. or even higher. The copper plating rate more than doubles (from 4.9 nm per minute to 10.7 nm per minute) when the plating temperature is increased from 25 to 35° C. This is in contrast with standard ECD copper plating from sulfuric plating baths where almost no temperature effect on the deposition rate is observed.

Also the specific resistivity of the plated copper films is strongly dependent on the plating temperature. A substantial increase of the specific resistivity with increasing deposition temperature is observed.

In one specific embodiment, a surfactant, Triton-X, (1 mL in 20 liters of plating bath) was added. At this surfactant level, there is practically no effect on either deposition rate nor specific resistivity of the deposited copper layer under identical plating conditions. The structure of the copper film is excellent in the presence of Triton-X. A (111) structure can be observed for a 200 inch wafer.

What is claimed is:

1. A method for the preparation of a composition for electroplating a copper-containing layer on a substrate, comprising the steps of:

(i) providing an aqueous solution comprising at least:
a source of copper Cu(II) ions,
an additive to adjust the pH to a predetermined value, and
a complexing agent for complexing Cu(II) ions, said complexing agent having the chemical formula:

$$COOR_1—COHR_2R_3$$

wherein $R_1$ is a hydrocarbon group covalently bound to the carboxylate group (COO),
$R_2$ is either hydrogen or an organic group, and
$R_3$ is either hydrogen or an organic group,
said solution comprising no reducing agent, (ii) providing electrons from a source not being in direct contact with said solution, through transport means providing contact between said source and said solution.

2. A method according to claim 1, wherein the source supplying electrons is placed in said solution.

3. A method according to claim 2, wherein the source supplying electrons is a current generator or a battery.

4. A method according to claim 3, wherein the transport means comprise electrodes bound to wires.

5. A method according to claim 2, wherein the source supplying electrons has a current density of from 0.32 $mA/cm^2$ to 3.82 $mA/cm^2$.

6. A method according to claim 1, wherein $R_2$ is hydrogen and $R_3$ is an organic group.

7. A method according to claim 1, wherein $R_2$ is hydrogen and $R_3$ is —CHOH—$COOR_1$.

8. A method according to claim 1, wherein said complexing agent is selected from the group consisting of L-diethyltartrate, L-diisopropyltartrate, L-dimethyltartrate, L-dibutyltartrate, D-diethyltartrate, D-diisopropyltartrate, D-dimethyltartrate, D-dibutyltartrate, and mixtures thereof.

9. A method according to claim 1, wherein the source of copper Cu(II) ions in the solution is $CuSO_4.5H_2O$.

10. A method according to claim 1, wherein the additive to adjust the pH of the composition is $[Me_4N]OH$ (TMAH).

11. A method according to claim 1, wherein the pH of said composition is from 11 to 13.5.

12. A method according to claim 1, wherein the pH of said composition is from 12 to 13.5.

13. A method according to claim 1, wherein the pH of said composition is from 12.3 to 13.3.

14. A process for forming at least one copper-containing layer on a substrate comprising at least the step of electroplating a copper-containing layer onto said substrate in a first electroplating bath, wherein said electroplating bath is the composition prepared by the method according to claim 1.

15. A process according to claim 14, wherein the temperature of the composition is from 10° C. to 50° C.

16. A process according to claim 14, wherein said copper-containing layer is formed directly on said substrate.

17. A process according to claim 14, wherein said copper-containing layer is formed indirectly on said substrate after a pre-step of forming a primary layer on said substrate, so that said copper-containing layer is formed on said primary layer.

18. A process according to claim 17, wherein said primary layer is a copper diffusion barrier layer.

19. A process according to claim 18, wherein said copper diffusion barrier layer is metal conductive or not.

20. A process according to claim 19, wherein said copper diffusion barrier layer is selected from the group consisting of a Ti layer, a TiN layer, a Ta layer, a $WN_x$ layer, a TaN layer, a Co layer and a Co-alloy layer.

21. A process according to claim 14, wherein the resulting copper-containing layer is a copper seed layer.

22. A process according to claim 21, further comprising the step of forming another copper-containing layer on the last formed copper seed layer using a second electroplating bath.

23. A process according to claim 22, wherein the second electroplating bath is the first electroplating bath used for forming the copper seed layer.

24. A process according to claim 22, wherein the second electroplating bath is a cupric-sulfuric acid-based electroplating bath.

25. A process according to claim 14, wherein the temperature of the composition is from room temperature to 45° C.

* * * * *